US009343027B2

(12) United States Patent
Zhu et al.

(10) Patent No.: US 9,343,027 B2
(45) Date of Patent: May 17, 2016

(54) GATE DRIVE CIRCUIT, ARRAY SUBSTRATE AND DISPLAY DEVICE

(71) Applicants: BOE TECHNOLOGY GROUP CO., LTD., Beijing (CN); BOE (Hebei) Mobile Display Technology Co., Ltd., Gu'An, Hebei (CN)

(72) Inventors: Mingyan Zhu, Beijing (CN); Jia Wang, Beijing (CN); Xiangyuan Sheng, Beijing (CN); Weihou Li, Beijing (CN); Lingling Dong, Beijing (CN)

(73) Assignees: BOE TECHNOLOGY GROUP CO., LTD., Beijing (CN); BOE (HEBEI) MOBILE DISPLAY TECHNOLOGY CO., LTD., Hebei (CN)

( * ) Notice: Subject to any disclaimer, the term of this patent is extended or adjusted under 35 U.S.C. 154(b) by 37 days.

(21) Appl. No.: 14/573,637

(22) Filed: Dec. 17, 2014

(65) Prior Publication Data

US 2016/0055811 A1 Feb. 25, 2016

(30) Foreign Application Priority Data

Aug. 20, 2014 (CN) ..... 2014 1 0412533

(51) Int. Cl.
*G09G 3/36* (2006.01)

(52) U.S. Cl.
CPC ..... *G09G 3/3648* (2013.01); *G09G 2310/0283* (2013.01)

(58) Field of Classification Search
CPC . G09G 3/3648; G09G 3/3614; G09G 3/3677; G09G 3/3688; G09G 2310/0205; G09G 2310/027; G09G 2310/0286; G09G 2320/0204; G09G 2320/0233; G09G 2310/0281; G09G 2310/0267; G09G 2310/0297; G09G 3/329
USPC ..... 377/67, 69, 79
See application file for complete search history.

(56) References Cited

U.S. PATENT DOCUMENTS

| | | | | |
|---|---|---|---|---|
| 7,872,629 | B2 * | 1/2011 | Edo | G09G 3/20 345/100 |
| 8,605,027 | B2 * | 12/2013 | Pak | G09G 3/3677 315/169.2 |
| 2006/0221040 | A1 * | 10/2006 | Pak | G11C 19/287 345/100 |
| 2009/0058781 | A1 * | 3/2009 | Xu | G09G 3/3677 345/92 |
| 2009/0115792 | A1 * | 5/2009 | Otose | G11C 19/28 345/559 |
| 2010/0158188 | A1 * | 6/2010 | Lee | G09G 3/3677 377/79 |
| 2010/0207927 | A1 * | 8/2010 | Joo | G09G 3/3677 345/213 |

* cited by examiner

*Primary Examiner* — Duc Dinh
(74) *Attorney, Agent, or Firm* — Nath, Goldberg & Meyer; Joshua B. Goldberg

(57) ABSTRACT

A gate drive circuit including cascaded gate drive units, an array substrate and a display device are provided. In each gate drive unit, a first phase inverter module is connected with first and second driving modules and an intermediate signal generation module, and is used for inverting a clock signal received by a clock signal input terminal; the intermediate signal generation module is connected with first and second signal input terminals, a clock signal input terminal, first and second signal output terminals and an output terminal of the first phase inverter module, and generates an intermediate signal under the control of control signals received by the first and the second signal input terminals, the clock signal and the inverted clock signal; the first and the second driving modules scan the respective gate lines connected thereto under the control of the inverted clock signal and the intermediate signal.

17 Claims, 3 Drawing Sheets

GATE DRIVE CIRCUIT, ARRAY SUBSTRATE AND DISPLAY DEVICE

FIELD OF THE INVENTION

The present invention relates to the field of display technology, and particularly relates to a gate drive circuit, an array substrate and a display device.

BACKGROUND OF THE INVENTION

At present, liquid crystal displays are commonly used flat panel displays, and thin film transistor liquid crystal displays (TFT-LCD for short) are mainstream products of the liquid crystal displays. With the increasingly competition in liquid crystal display products, the manufacturers have employed new techniques to reduce product costs and enhance market competiveness. Among these techniques, Gate drive on Array (GOA) technique refers to a technique in which a gate drive circuit of the liquid crystal display is integrated on an array substrate. Compared with conventional COF (Chip On Flex/Film) technique and COG (Chip On Glass) technique, GOA technique can not only reduce cost, but also make the bezel of the liquid crystal display narrower, thus the design of narrow bezel is realized.

However, in the prior art, the gate drive circuit includes cascaded gate drive units, each of which is only connected with one gate line. That is to say, each gate drive unit scans only one gate line. Therefore, the area of this gate drive circuit is relatively large, thereby affecting the effective display area of the display.

SUMMARY OF THE INVENTION

The present invention is made in consideration of the above problem existing in the prior gate drive circuit. The present invention provides a gate drive circuit with a relatively small area, an array substrate including the gate drive circuit and a display device including the array substrate.

To achieve the above objective, the present invention provides a gate drive circuit, which includes cascaded gate drive units, wherein each of the gate drive units is used to drive two adjacent gate lines. Each gate drive unit includes a clock signal input terminal, a first signal input terminal, a first signal output terminal, a second signal input terminal, a second signal output terminal, a first phase inverter module, an intermediate signal generation module, a first driving module and a second driving module, wherein for each of the gate drive units, the first signal input terminal is used for receiving a control signal output from the gate drive unit in its next stage and the second signal input terminal is used for receiving a control signal output from the gate drive unit in its previous stage;

for each of the gate drive units, the first signal output terminal is used for outputting a control signal to the gate drive unit in its previous stage and the second signal output terminal is used for outputting a control signal to the gate drive unit in its next stage;

the first phase inverter module is connected with the first driving module, the second driving module and the intermediate signal generation module, and is used for inverting a clock signal received by the clock signal input terminal, and the first driving module, the second driving module and the intermediate signal generation module are controlled by the inverted clock signal;

the intermediate signal generation module is connected with the first signal input terminal, the second signal input terminal, the clock signal input terminal, the first signal output terminal, the second signal output terminal and an output terminal of the first phase inverter module, and generates an intermediate signal under the control of the control signals input from the first signal input terminal and the second signal input terminal, the clock signal and the inverted clock signal, and outputs a control signal to the gate drive unit in its previous stage through the first signal output terminal and outputs a control signal to the gate drive unit in its next stage through the second signal output terminal; and the first driving module and the second driving module output corresponding scanning signals under the control of the inverted clock signal and the intermediate signal, so as to scan the respective gate lines connected thereto.

Since each gate drive unit in the gate drive circuit of the present invention can drive two gate lines, the occupied area of the gate drive circuit of the present invention is relatively small.

Preferably, each of the gate drive units further includes a bidirectional scanning control signal input terminal, a second phase inverter module, a third phase inverter module, a scanning direction control module and a clock selection module, wherein the bidirectional scanning control signal input terminal is used for receiving a bidirectional scanning control signal;

the second phase inverter module is connected with the scanning direction control module, and is used for inverting the bidirectional scanning control signal, and gating of the scanning direction control module is controlled by the inverted bidirectional scanning control signal;

the scanning direction control module is connected with the first signal input terminal, the second signal input terminal and the intermediate signal generation module, and transfers the control signals received by the first signal input terminal and the second signal input terminal to the intermediate signal generation module under the control of the inverted bidirectional scanning control signal, so as to generate an intermediate signal;

the clock selection module is connected with the first phase inverter module, the clock signal input terminal, the first driving module and the bidirectional scanning control signal input terminal, and is used for generating a first clock signal under the control of the clock signal, the inverted clock signal and the bidirectional scanning control signal;

the third phase inverter module is connected with the clock selection module and the second driving module, and is used for inverting the first clock signal;

the first driving module outputs a scanning signal to a gate line connected thereto under the control of the first clock signal and the intermediate signal; and the second driving module outputs a scanning signal to a gate line connected thereto under the control of the inverted first clock signal and the intermediate signal.

Further preferably, the first inverter module includes a first transistor and a second transistor, wherein the first transistor is a P-type transistor and the second transistor is an N-type transistor;

a first electrode of the first transistor is connected with a high-level signal input terminal, a second electrode thereof is connected with a second electrode of the second transistor and a control electrode thereof is connected with a control electrode of the second transistor and the clock signal input terminal; and a first electrode of the second transistor is connected with a low-level signal input terminal.

Further preferably, the second phase inverter module includes a third transistor and a fourth transistor, wherein the third transistor is a P-type transistor and the fourth transistor is an N-type transistor;

a first electrode of the third transistor is connected with a high-level signal input terminal, a second electrode thereof is connected with a second electrode of the fourth transistor and a control electrode thereof is connected with the bidirectional scanning control signal input terminal; and a first electrode of the fourth transistor is connected with a low-level signal input terminal.

Further preferably, the scanning direction control module includes a fifth transistor, a sixth transistor, a seventh transistor and an eighth transistor, wherein the fifth transistor and the seventh transistor are P-type transistors, and the sixth transistor and the eighth transistor are N-type transistors;

a first electrode of the fifth transistor is connected with a first electrode of the sixth transistor and the second signal input terminal, a second electrode thereof is connected with a second electrode of the sixth transistor, a second electrode of the seventh transistor and a second electrode of the eighth transistor, and a control electrode thereof is connected with the second electrode of the third transistor and a control electrode of the eighth transistor;

a control electrode of the sixth transistor is connected with a control electrode of the seventh transistor and the bidirectional scanning control signal input terminal; and a first electrode of the seventh transistor is connected with a first electrode of the eighth transistor and the first signal input terminal.

Further preferably, the intermediate signal generation module includes a ninth transistor, a tenth transistor, an eleventh transistor, a twelfth transistor, a thirteenth transistor, a fourteenth transistor, a fifteenth transistor, a sixteenth transistor and a intermediate signal output terminal, wherein the ninth transistor, the eleventh transistor, the fourteenth transistor and the fifteenth transistor are P-type transistors and the tenth transistor, the twelfth transistor, the thirteenth transistor and the sixteenth transistor are N-type transistors, and the intermediate signal generation module outputs a generated intermediate signal through the intermediate signal output terminal;

a first electrode of the ninth transistor is connected with a first electrode of the tenth transistor and the second electrode of the fifth transistor, a second electrode thereof is connected with a second electrode of the tenth transistor, a control electrode of the eleventh transistor and a control electrode of the twelfth transistor, and a control electrode thereof is connected with the second electrode of the first transistor;

a control electrode of the tenth transistor is connected with the clock signal input terminal;

a first electrode of the eleventh transistor is connected with a high-level signal input terminal, a second electrode thereof is connected with a second electrode of the twelfth transistor, a first electrode of the thirteenth transistor, a first electrode of the fourteenth transistor and the intermediate signal output terminal;

a first electrode of the twelfth transistor is connected with a low-level signal input terminal;

a second electrode of the thirteenth transistor is connected with a second electrode of the fourteenth transistor, a control electrode of the fifteenth transistor and a control electrode of the sixteenth transistor, and a control electrode thereof is connected with the control electrode of the ninth transistor;

a control electrode of the fourteenth transistor is connected with the clock signal input terminal;

a first electrode of the fifteenth transistor is connected with a high-level signal input terminal, a second electrode thereof is connected with a second electrode of the sixteenth transistor, the first signal output terminal and the second signal output terminal; and a first electrode of the sixteenth transistor is connected with a low-level signal input terminal.

Further preferably, the clock selection module includes a seventeenth transistor, an eighteenth transistor, a nineteenth transistor and a twentieth transistor, wherein the seventeenth transistor and the nineteenth transistor are P-type transistors and the eighteenth transistor and the twentieth transistor are N-type transistors;

a first electrode of the seventeenth transistor is connected with the second electrode of the first transistor and a first electrode of the eighteenth transistor, a second electrode thereof is connected with a second electrode of the eighteenth transistor, a second electrode of the nineteenth transistor and a second electrode of the twentieth transistor, and a control electrode thereof is connected with the control electrode of the fifth transistor and a control electrode of the twentieth transistor;

a control electrode of the eighteenth transistor is connected with a control electrode of the nineteenth transistor and the bidirectional scanning control signal input terminal; and a first electrode of the nineteenth transistor is connected with a first electrode of the twentieth transistor and the clock signal input terminal.

Further preferably, the third phase inverter module includes a twenty-first transistor and a twenty-second transistor, wherein the twenty-first transistor is a P-type transistor and the twenty-second transistor is a N-type transistor;

a first electrode of the twenty-first transistor is connected with a high-level signal input terminal, a second electrode thereof is connected with a second electrode of the twenty-second transistor, and a control electrode thereof is connected with a control electrode of the twenty-second transistor and the second electrode of the seventeenth transistor; and a first electrode of the twenty-second transistor is connected with a low-level signal input terminal;

Further preferably, the first driving module includes a twenty-third transistor, a twenty-fourth transistor, a twenty-fifth transistor and a twenty-sixth transistor, wherein the twenty-third transistor and the twenty-fourth transistor are P-type transistors and the twenty-fifth transistor and the twenty-sixth transistor are N-type transistors;

wherein a first electrode of the twenty-third transistor is connected with a high-level signal input terminal, a second electrode thereof is connected with a first electrode of the twenty-fourth transistor, and a control electrode thereof is connected with a control electrode of the twenty-fifth transistor and the second electrode of the seventeenth transistor;

a second electrode of the twenty-fourth transistor is connected with a second electrode of the twenty-fifth transistor, a second electrode of the twenty-sixth transistor and an output terminal of the first driving module, and a control electrode thereof is connected with a control electrode of the twenty-sixth transistor and the intermediate signal output terminal, wherein the output terminal of the first driving module is connected with a gate line; and a first electrode of the twenty-fifth transistor is connected with a first electrode of the twenty-sixth transistor and a low-level signal input terminal.

Further preferably, the second driving module includes a twenty-seventh transistor, a twenty-eighth transistor, a twenty-ninth transistor and a thirtieth transistor, wherein the twenty-seventh transistor and the twenty-eighth transistor are P-type transistors and the twenty-ninth transistor and the thirtieth transistor are N-type transistors;

a first electrode of the twenty-seventh transistor is connected with a high-level signal input terminal, a second electrode thereof is connected with a first electrode of the twenty-eighth transistor, and a control electrode thereof is connected with the second electrode of the twenty-first transistor and a control electrode of the twenty-ninth transistor;

a second electrode of the twenty-eighth transistor is connected with a second electrode of the twenty-ninth transistor, a second electrode of the thirtieth transistor and an output terminal of the second driving module, and a control electrode thereof is connected with a control electrode of the thirtieth transistor and the intermediate signal output terminal, wherein the output terminal of the second driving module is connected with another gate line; and a first electrode of the twenty-ninth transistor is connected with a first electrode of the thirtieth transistor and a low-level signal input terminal.

Even more preferably, the first transistor, the second transistor, the third transistor, the fourth transistor, the fifth transistor, the sixth transistor, the seventh transistor, the eighth transistor, the ninth transistor, the tenth transistor, the eleventh transistor, the twelfth transistor, the thirteenth transistor, the fourteenth transistor, the fifteenth transistor, the sixteenth transistor, the seventeenth transistor, the eighteenth transistor, the nineteenth transistor, the twentieth transistor, the twenty-first transistor, the twenty-second transistor, the twenty-third transistor, the twenty-fourth transistor, the twenty-fifth transistor, the twenty-sixth transistor, the twenty-seventh transistor, the twenty-eighth transistor, the twenty-ninth transistor and the thirtieth transistor are low temperature poly-silicon thin film transistors.

The present invention further provides an array substrate, which includes the above gate drive circuit and a plurality of gate lines connected to the gate drive circuit.

The present invention further provides a display device, which includes the above array substrate and a clock signal generation unit which provides a clock signal for the gate drive circuit on the array substrate.

Preferably, the display device further includes a bidirectional scanning control signal generation unit which provides a bidirectional scanning control signal for the gate drive circuit on the array substrate.

Figure 1:
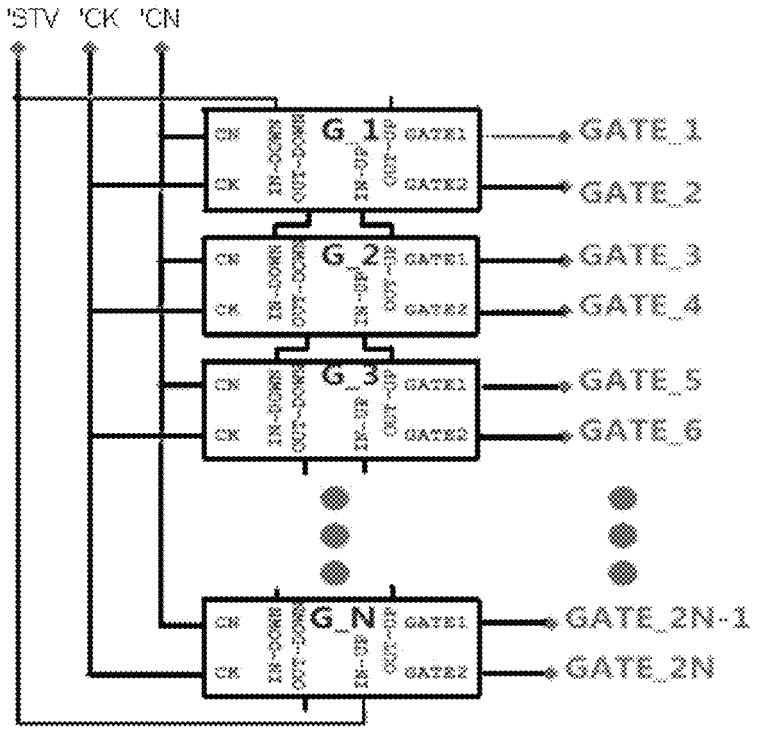
FIG. 1 is a schematic diagram of a gate drive circuit of Embodiment 1 of the present invention.

Reference numerals: 1, first phase inverter module; 2, second phase inverter module; 3, scanning direction control module; 4, intermediate signal generation module; 5, clock selection module; 6, third phase inverter module; 7, first driving module; 8, second driving module; 'CK, clock signal input terminal; 'CN, bidirectional scanning control signal input terminal; IN-UP, first signal input terminal; OUT-UP, first signal output terminal; IN-DOWN, second signal input terminal; OUT-DOWN, second signal output terminal.

DETAILED DESCRIPTION OF THE EMBODIMENTS

To make a person skilled in the art better understand the technical solutions of the present invention, the present invention will be described in more details in conjunction with the accompanying drawings and specific embodiments.

Embodiment 1

Figure 2:
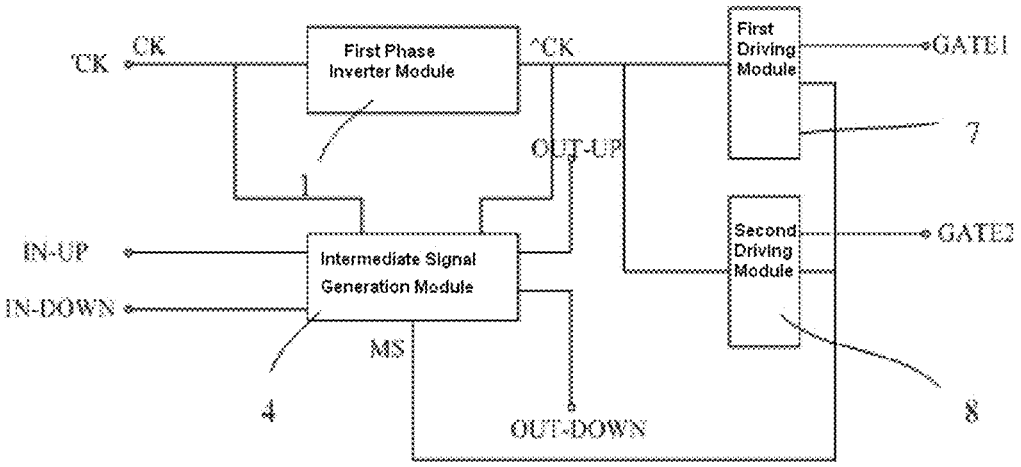
FIG. 2 is a schematic diagram of a gate drive unit of the gate drive circuit of Embodiment 1 of the present invention.

The present embodiment provides a gate drive circuit, which includes a plurality of cascaded gate drive units. As shown in FIG. 1, the gate drive units (G_1, G_2 . . . G_N) are cascaded together through their respective first signal input terminals IN-UP, first signal output terminals OUT-UP, second signal input terminals IN-DOWN and second signal output terminals OUT-DOWN, and each of the gate drive units is used for driving two adjacent gate lines. It should be noted that, the second signal input terminal IN-DOWN of the gate drive unit G_1 in the first stage is connected with the first signal input terminal IN-UP of the gate drive unit G_N in the Nth stage and the Start Vertical Signal input terminal 'STV. As shown in FIG. 2, the gate drive unit includes a clock signal input terminal 'CK, a first signal input terminal IN-UP, a first signal output terminal OUT-UP, a second signal input terminal IN-DOWN, a second signal output terminal OUT-DOWN, a first phase inverter module 1, an intermediate signal generation module 4, a first driving module 7 and a second driving module 8. For each of the gate drive units, the first signal input terminal IN-UP is used for receiving a control signal output from the gate drive unit in its next stage and the second signal input terminal IN-DOWN is used for receiving a control signal output from the gate drive unit in its previous stage; and for each of the gate drive units, the first signal output terminal OUT-UP is used for outputting a control signal to the gate drive unit in its previous stage and the second signal output terminal OUT-DOWN is used for outputting a control signal to the gate drive unit in its next stage. The first phase inverter module 1 is connected with the first driving module 7, the second driving module 8 and the intermediate signal generation module 4, and is used for inverting a clock signal CK received by the clock signal input signal 'CK, and the first driving module 7, the second driving module 8 and the intermediate signal generation module 4 are controlled by the inverted clock signal ˆCK. The intermediate signal generation module 4 is connected with the first signal input terminal IN-UP, the second signal input terminal IN-DOWN, the clock signal input terminal 'CK, the first signal output terminal OUT-UP, the second signal output terminal OUT-DOWN and the output terminal of the first phase inverter module 1. The intermediate signal generation module 4 generates an intermediate signal MS under the control of the control signals received by the first signal input terminal IN-UP and the second signal input terminal OUT-UP, the clock signal CK and the inverted clock signal ˆCK. The intermediate signal generation module 4 outputs a control signal to the gate drive unit in its previous stage through the first signal output terminal OUT-UP, and outputs a control signal to the gate drive unit in its next stage through the second signal output terminal OUT-DOWN. The first driving module 7 and the second driving module 8 output corresponding scanning signals under the control of the inverted clock signal ˆCK and the intermediate signal MS, so as to scan the respective gate lines connected thereto.

In the present embodiment, each gate drive unit of the gate drive circuit can drive two gate lines, and compared with a gate drive circuit in which each gate drive unit only drives one gate line, the number of the gate drive units can be reduced. Therefore, the area occupied by the gate drive circuit on an array substrate can be reduced and thus an area of a portion of the array substrate used for displaying effectively can be increased, which is beneficial to increase the aperture ratio.

Figure 3:
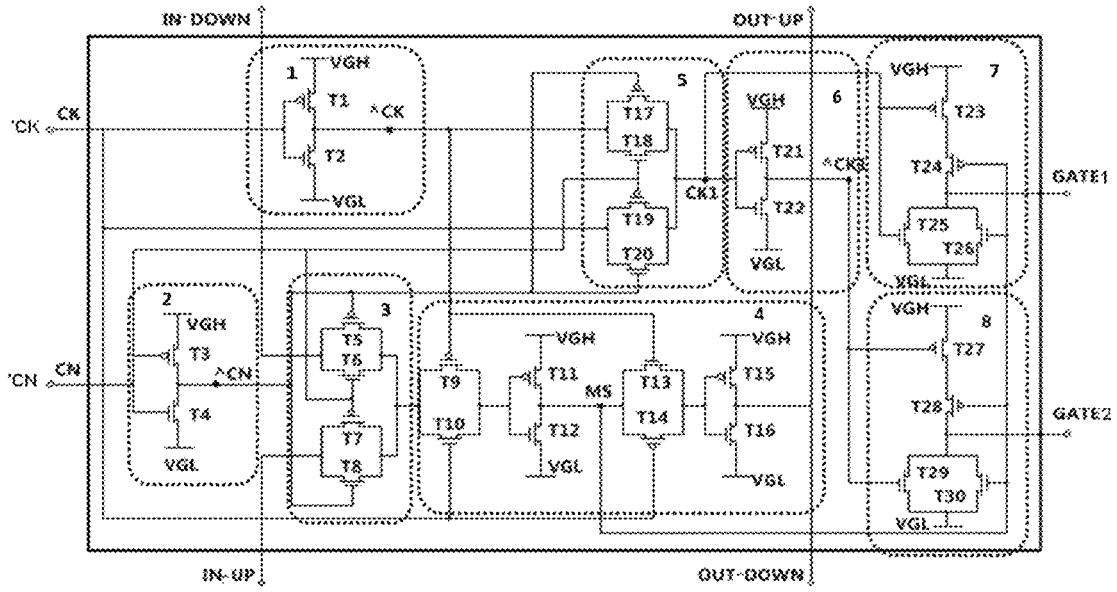
FIG. 3 is a circuit diagram of the gate drive unit of the gate drive circuit of Embodiment 1 of the present invention.

As shown in FIG. 1 and FIG. 3, preferably, in the gate drive circuit of the present embodiment, each gate drive unit further includes a bidirectional scanning control signal input terminal 'CN, a second phase inverter module 2, a third phase inverter module 6, a scanning direction control module 3 and a clock selection module 5. The bidirectional scanning control signal input terminal 'CN is used for receiving a bidirectional scanning control signal CN. The second phase inverter module 2 is connected with the scanning direction control module 3, and is used for inverting the bidirectional scanning control signal CN. The inverted bidirectional scanning control signal ˆCN is used for controlling gating of the scanning direction control module 3. The scanning direction control module 3 transfers the control signals received by the first signal input terminal IN-UP and the second signal input signal IN-DOWN to the intermediate signal generation module 4 under the control of the inverted bidirectional scanning control signal ˆCN, so as to control the intermediate signal generation module 4 to generate an intermediate signal MS. The clock selection module 5 is connected with the first phase inverter module 1, the clock signal input terminal 'CK and the bidirectional scanning control signal input terminal 'CN, and generates a first clock signal CK1 under the control of the inverted clock signal ˆCK, the clock signal CK and the bidirectional scanning control signal CN, so as to control the scanning sequence (that is, all gate lines are scanned from top to bottom or from bottom to top) of the gate lines connected with the first driving module 7 and the second driving module 8. The third phase inverter module 6 is connected with the clock selection module 5 and the first driving module 7, and is used for inverting the first clock signal CK1 to generate an inverted first clock signal ˆCK1. The first driving module 7 drives the gate line connected thereto under the control of the first clock signal CK1 and the intermediate signal MS. The second driving module 8 drives the gate line connected thereto under the control of the inverted first clock signal ˆCK1 and the intermediate signal MS.

Since the gate drive unit in the present embodiment further includes the bidirectional scanning control signal input terminal 'CN, the second phase inverter module 2, the third phase inverter module 6, the scanning direction control module 3 and the clock selection module 5, the gate drive circuit including the gate drive unit can realize bidirectional scanning. That is to say, the gate lines can be scanned line by line from top to bottom, and the gate lines can also be scanned line by line from bottom to top.

Specifically, in the present embodiment, preferably, the first phase inverter module 1 includes a first transistor T1 and a second transistor T2; the second phase inverter module 2 includes a third transistor T3 and a fourth transistor T4; the scanning direction control module 3 includes a fifth transistor T5, a sixth transistor T6, a seventh transistor T7 and an eighth transistor T8; the intermediate signal generation module 4 includes a ninth transistor T9, a tenth transistor T10, an eleventh transistor T11, a twelfth transistor T12, a thirteenth transistor T13, a fourteenth transistor T14, a fifteenth transistor T15 and a sixteenth transistor T16; the clock selection module 5 includes a seventeenth transistor T17, an eighteenth transistor T18, a nineteenth transistor T19 and a twentieth transistor T20; the third phase inverter module 6 includes a twenty-first transistor T21 and a twenty-second transistor T22; the first driving module 7 includes a twenty-third transistor T23, a twenty-fourth transistor T24, a twenty-fifth transistor T25 and a twenty-sixth transistor T26; the second driving module 8 includes a twenty-seventh transistor T27, a twenty-eighth transistor T28, a twenty-ninth transistor T29 and a thirtieth transistor T30. In the present embodiment, the first transistor T1, the third transistor T3, the fifth transistor T5, the seventh transistor T7, the ninth transistor T9, the eleventh transistor T11, the fourteenth transistor T14, the fifteenth transistor T15, the seventeenth transistor T17, the nineteenth transistor T19, the twenty-first transistor T21, the twenty-third transistor T23, the twenty-fourth transistor T24, the twenty-seventh transistor T27 and the twenty-eighth transistor T28 are P-type transistors; the second transistor T2, the fourth transistor T4, the sixth transistor T6, the eighth transistor T8, the tenth transistor T10, the twelfth transistor T12, the thirteenth transistor T13, the sixteenth transistor T16, the eighteenth transistor T18, the twentieth transistor T20, the twenty-second transistor T22, the twenty-fifth transistor T25, the twenty-sixth transistor T26, the twenty-ninth transistor T29 and the thirtieth transistor T30 are N-type transistors. In the present embodiment, a first electrode of the first transistor T1 is connected with a high-level signal input terminal VGH, a second electrode thereof is connected with a second electrode of the second transistor T2, a first electrode of the seventeenth transistor T17, a first electrode of the eighteenth transistor T18, a control electrode of the ninth transistor T9 and a control electrode of the thirteenth transistor T13, and a control electrode thereof is connected with a control electrode of the second transistor T2, the clock signal input terminal 'CK, a control electrode of the tenth transistor T10, a control electrode of the fourteenth transistor T14, a first electrode of the nineteenth transistor T19 and a first electrode of the twentieth transistor T20; a first electrode of the second transistor T2 is connected with a low-level signal input terminal VGL; a first electrode of the third transistor T3 is connected with a high-level signal input terminal VGH, a second electrode thereof is connected with a second electrode of the fourth transistor T4, a control electrode of the fifth transistor T5, a control electrode of the eighth transistor T8, a control electrode of the seventeenth transistor T17 and a control electrode of the twentieth transistor T20, and a control electrode thereof is connected with the bidirectional scanning control signal input terminal 'CN, a control electrode of the fourth transistor T4, a control electrode of the eighteenth transistor T18 and ad control electrode of the nineteenth transistor T19; a first electrode of the fourth transistor T4 is connected with a low-level signal input terminal VGL; a first electrode of the fifth transistor T5 is connected with a first electrode of the sixth transistor T6 and the second signal input terminal IN-DOWN, a second electrode thereof is connected with a second electrode of the sixth transistor T6, a first electrode of the ninth transistor T9, a first electrode of the tenth transistor T10, a second electrode of the seventh transistor T7 and a second electrode of the eighth transistor T8; a first electrode of the seventh transistor T7 is connected with a first electrode of the eighth transistor T8 and the first signal input terminal IN-UP; a second electrode of the ninth transistor T9 is connected with a second electrode of the tenth transistor T10, a control electrode of the eleventh transistor T11 and a control electrode of the twelfth transistor T12; a first electrode of the eleventh transistor T11 is connected with a high-level signal input terminal VGH, a second electrode thereof is connected with a second electrode of the twelfth transistor T12, a first electrode of the thirteenth transistor T13, a first electrode of the fourteenth transistor T14, a control electrode of the twenty-fourth transistor T24, a control electrode of the twenty-sixth transistor T26, a control electrode of the twenty-eighth transistor T28 and a control electrode of the thirtieth transistor T30; a first electrode of the twelfth transistor T12 is connected with a low-level signal input terminal VGL; a second electrode of the thirteenth transistor T13 is connected with a second electrode of the fourteenth transistor T14, a control electrode of the fifteenth transistor T15 and a control electrode of the sixteenth transistor T16; a first electrode of the fifteenth transistor T15 is connected with a high-level signal input terminal VGH, a second electrode thereof is connected with a second electrode of the sixteenth transistor T16, the first signal output terminal OUT-UP and the second signal output terminal OUT-DOWN; a first electrode of the sixteenth transistor T16 is connected with a low-level signal input terminal VGL; a second electrode of the seventeenth transistor T17 is connected with a second electrode of the eighteenth transistor T18, a second electrode of the nineteenth transistor T19, a second electrode of the twentieth transistor T20, a control electrode of the twenty-first transistor T21, a control electrode of the twenty-second transistor T22, a control electrode of the twenty-third transistor T23 and a control electrode of the twenty-fifth transistor T25; a first electrode of the twenty-first transistor T21 is connected with a high-level signal input terminal VGH, a second electrode thereof is connected with a second electrode of the twenty-second transistor T22, a control electrode of the twenty-seventh transistor T27 and a control electrode of the twenty-ninth transistor T29; a first electrode of the twenty-second transistor T22 is connected with a low-level signal input terminal VGL; a first electrode of the twenty-third transistor T23 is connected with a high-level signal input terminal VGH, a second electrode thereof is connected with a first electrode of the twenty-fourth transistor T24; a second electrode of the twenty-fourth transistor T24 is connected with a second electrode of the twenty-fifth transistor T25, a second electrode of the twenty-sixth transistor T26 and an output terminal of the first driving module 7, wherein the output terminal of the first driving module 7 is connected with a gate line; s first electrode of the twenty-fifth transistor T25 is connected with s first electrode of the twenty-sixth transistor T26 and a low-level signal input terminal VGL; a first electrode of the twenty-seventh transistor T27 is connected with a high-level signal input terminal VGH, and a second electrode thereof is connected with a first electrode of the twenty-eighth transistor T28; a second electrode of the twenty-eighth transistor T28 is connected with a second electrode of the twenty-ninth transistor T29, a second electrode of the thirtieth transistor T30 and an output terminal of the second driving module 8, wherein the output terminal of the second driving module 8 is connected with another gate line; and a first electrode of the twenty-ninth transistor T29 is connected with a first electrode of the thirtieth transistor 130 and a low-level signal input terminal VGL.

Hereinafter, processes of scanning gate lines by using the gate drive unit provided by the present embodiment will be described in more details.

Figure 4:
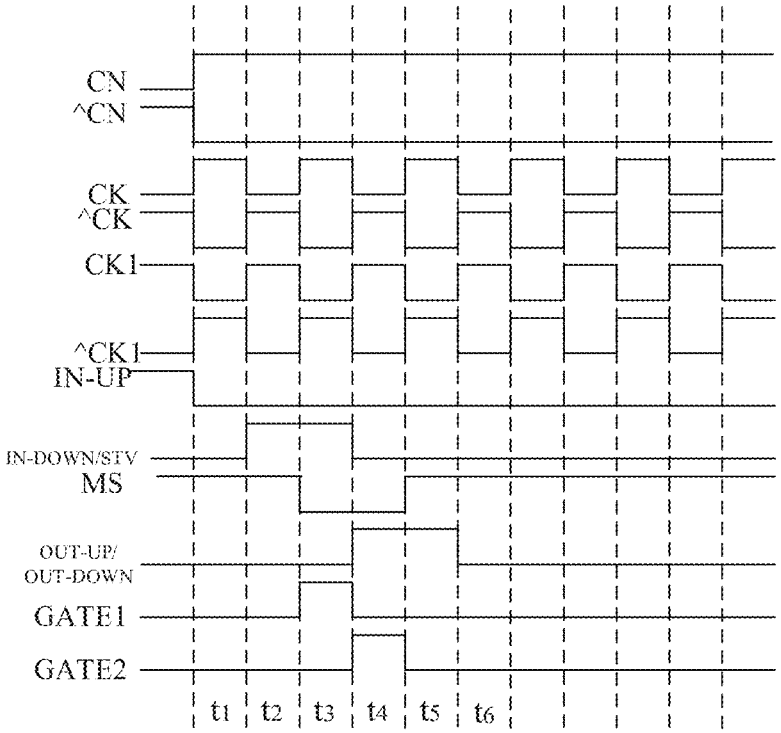
FIG. 4 is a timing diagram of scanning from top to bottom by the gate drive unit shown in FIG. 3.

First, a process of scanning gate lines line by line from top to bottom is described with reference to FIGS. 3 and 4, FIG. 4 is a timing diagram of scanning from top to bottom by the gate drive unit shown in FIG. 3.

As shown in FIGS. 3 and 4, in t1, the bidirectional scanning control signal CN received through the bidirectional scanning control signal input terminal 'CN is at a high level (and remains at the high level), and the inverted bidirectional scanning control signal ˆCN which is obtained by inverting the bidirectional scanning control signal input terminal CN by the second phase inverter module 2 is at a low level (and remains at the low level). Specifically, during t1, the bidirectional scanning control signal CN is at a high level, so that the fourth transistor T4 in the second phase inverter module 2 is turned on and the third transistor T3 is cut off. Since the first electrode of the fourth transistor T4 is connected with a low-level signal input terminal VGL, the inverted bidirectional scanning control signal ˆCN output from the second phase inverter module 2 is at a low level. It can be understood that, the clock selection module 5 is constituted by two transmission gates, that is, a transmission gate constituted by the seventeenth transistor T17 and the eighteenth transistor T18 and another transmission gate constituted by the nineteenth transistor T19 and the twentieth transistor T20. In this case, since the bidirectional scanning control signal CN is at a high level, the transmission gate constituted by the seventeenth transistor T17 and the eighteenth transistor T18 is turned on, so that the inverted clock signal ˆCK is input to the transmission gate constituted by the seventeenth transistor T17 and the eighteenth transistor T18 and then is output as the first clock signal CK1 of the clock selection module 5, and the timing of the first clock signal CK1 is the same as that of the inverted clock signal ˆCK. In this case, the timing of the inverted first clock signal ˆCK1 obtained by the third phase inverter module 6 is the same as that of the clock signal CK. Since the bidirectional scanning control signal CN is at a high level, and the inverted bidirectional scanning control signal ˆCN is at a low level, the seventh transistor T7 and the eighth transistor T8 are turned off, that is to say, the control signal (the STV signal for the gate drive unit in the last stage) output from the gate drive unit in the next stage and received by the first signal input terminal IN-UP cannot enter the gate drive circuit in the current stage; meanwhile, the fifth transistor T5 and the sixth transistor T6 are turned on, that is to say, the second signal input terminal IN-DOWN receives the control signal (the STV signal for the gate drive unit in the first stage) output from the gate drive circuit in its previous stage.

In t2, at the falling edge of the clock signal CK input from the clock signal input terminal 'CK, the control signal received by the second signal input terminal IN-DOWN and output from the gate drive circuit in the previous stage of the current gate drive unit or the STV signal (Start Vertical signal) changes to a high level and remains at the high level for one clock period (t2+t3).

In t3, the clock signal CK changes to a high level, and the inverted clock signal ˆCK which is obtained by inverting the clock signal CK by the first phase inverter module 1 changes to a low level. The first phase inverter module 1 is constituted by the first transistor T1 and the second transistor T2, and the working principle thereof is the same as that of the second phase inverter module 2, and therefore, it will not be redundantly described herein. In this case, since the inverted clock signal ˆCK is at a low level and the clock signal CK is at a high level, the ninth transistor T9 and the tenth transistor T10 in the intermediate signal generation module 4 are turned on. Meanwhile, since the bidirectional scanning control signal CN is at a high level and the inverted bidirectional scanning control signal ˆCN is at a low level, the fifth transistor T5 and the sixth transistor T6 are turned on. In this case, the control signal or the STV signal received by the second signal input terminal IN-DOWN is transferred to a logic inverter, which is constituted by the eleventh transistor T11 and the twelfth transistor T12, in the intermediate signal generation module 4 via the fifth transistor T5, the sixth transistor T6, the ninth transistor T9 and the tenth transistor T10, and then an intermediate signal MS (the intermediate signal is also a logic level signal, that is, a high-level signal or a low-level signal) is output. At this point, since the control signal or the STV signal received by the second signal input terminal IN-DOWN is a high-level signal, the twelfth transistor T12 is turned on and the eleventh transistor T11 is cut off, so that the intermediate signal MS is changed from a high-level signal to a low-level signal (and remains at the low level for one clock period (t3+t4)). As a result, the twenty-fourth transistor T24 is turned on and the twenty-sixth transistor T26 is cut off. Meanwhile, since the inverted first clock signal ˆCK1 is at a low level, the twenty-third transistor T23 is turned on and the twenty-fifth transistor T25 is cut off. Therefore, at t3, the output terminal GATE1 of the first driving module 7 outputs a high-level signal, so as to scan the gate line connected with the first driving module 7.

In t4, the clock signal CK changes from a high level to a low level and the first clock signal CK1 changes from a low level to a high level, so that the twenty-third transistor T23 is cut off and the twenty-fifth transistor T25 is turned on, and at this time, the output terminal GATE1 of the first driving module 7 outputs a low-level signal. Since the first clock signal CK1 is at a high level, in the third phase inverter module 6, the twenty-second transistor T22 is turned on and the twenty-first transistor T21 is cut off, thus the inverted first clock signal ˆCK1 changes to a low level, so that the twenty-seventh transistor T27 is turned on. Meanwhile, since the intermediate signal MS is at a low level, the twenty-eighth transistor T28 is turned on. That is to say, at this time, the output terminal GATE2 of the second driving module 8 outputs a high-level signal, so as to scan the gate line connected with the second driving module 8. Meanwhile, in t4, since the inverted clock signal ˆCK is at a high level and the clock signal CK is at a low level, the transmission gate constituted by the thirteenth transistor T13 and the fourteenth transistor T14 is turned on, and the intermediate signal MS passes through the transmission gate and then passes through a logic inverter constituted by the fifth transistor T15 and the sixteenth transistor T16. Since the intermediate signal MS is at a low level, both the control signal output to the gate drive unit in its previous stage by the first signal output terminal OUT-UP and the control signal output to the gate drive unit in its next stage by the second signal output terminal OUT-DOWN are at high levels.

In t5, the clock signal CK and the inverted first clock signal ˆCK1 change to high levels again, and the first clock signal CK1 and the inverted clock signal ˆCK change to low levels again. Meanwhile, since the control signal or the STV signal received by the second signal input terminal IN-DOWN is at a low level, the intermediate signal MS changes to a high level. In this case, both the twenty-fourth transistor T24 and the twenty-eighth transistor T28 are cut off, while both the twenty-sixth transistor T26 and the thirtieth transistor T30 are turned on, thus both the output terminal GATE1 of the first driving module 7 and the output terminal GATE2 of the second driving module 8 output low-level signals. Meanwhile, since the transmission gate constituted by the thirteenth transistor T13 and the fourteenth transistor T14 is cut off, both the control signal output to the gate drive unit in its previous stage by the first signal output terminal OUT-UP and the control signal output to the gate drive unit in its next stage by the second signal output terminal OUT-DOWN remain at high levels.

In t6, when the clock signal CK changes to a low level again, the transmission gate constituted by the thirteenth transistor T13 and the fourteenth transistor T14 in the intermediate signal generation module 4 is turned on again. The intermediate signal MS passes through this transmission gate and then passes through the logic inverter constituted by the fifteenth transistor T15 and the sixteenth transistor T16. At this time, since the intermediate signal MS is at a high level, both the control signal output to the gate drive unit in its previous stage by the first signal output terminal OUT-UP and the control signal output to the gate drive unit in its next stage by the second signal output terminal OUT-DOWN are at low levels.

Each of the gate drive units in the gate drive circuit operates in the above described manner, so as to complete display of one frame.

Figure 5:
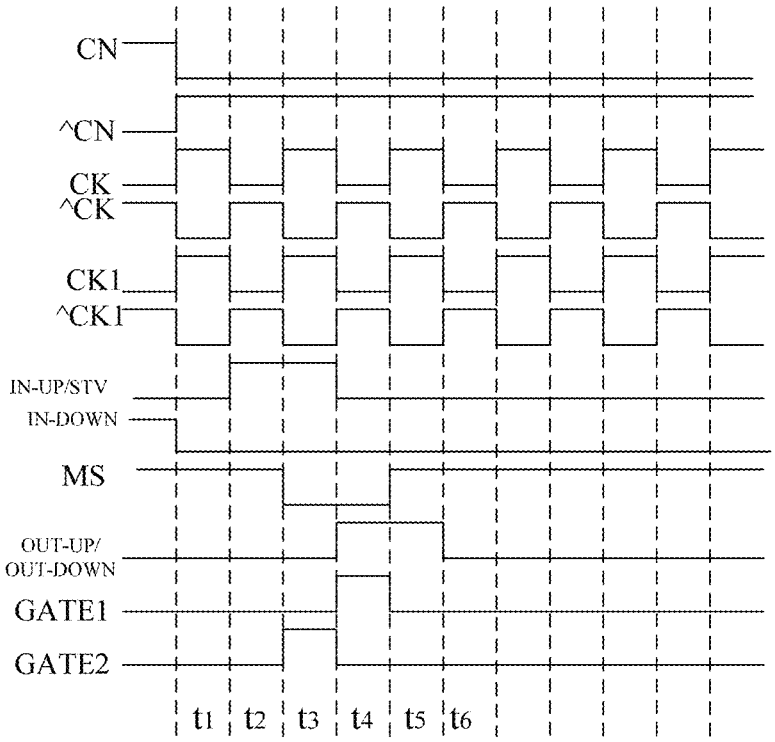
FIG. 5 is a timing diagram of scanning from bottom to top by the gate drive unit shown in FIG. 3.

Thereinafter, a process of scanning gate lines line by line from bottom to top is described with reference to FIGS. 3 and 5, and FIG. 5 is a timing diagram of scanning from bottom to top by the gate drive unit shown in FIG. 3.

As shown in FIGS. 3 and 5, in t1, the bidirectional scanning control signal CN received by the bidirectional scanning control signal input terminal 'CN is at a low level (and remains at the low level), and the inverted bidirectional scanning control signal ˆCN, which is obtained by inverting the bidirectional scanning control signal CN by the second phase inverter module 2, is at a high level (and remains at the high level). Specifically, the bidirectional scanning control signal CN is at a low level, so that in the second phase inverter module 2, the third transistor T3 is turned on and the fourth transistor T4 is cut off. Since the first electrode of the third transistor T3 is connected with a high-level signal input terminal VGH, the inverted bidirectional scanning control signal ˆCN output from the second phase inverter module 2 is at a high level. It can be understood that, the clock selection module 5 is constituted by two transmission gates, that is, a transmission gate constituted by the seventeenth transistor T17 and the eighteenth transistor T18 and another transmission gate constituted by the nineteenth transistor T19 and the twentieth transistor T20. In this case, since the bidirectional scanning control signal CN is at a low level, the transmission gate constituted by the nineteenth transistor T19 and the twentieth transistor T20 is turned on, so that the clock signal CK is output as the first clock signal CK1 of the clock selection module 5, and the timing of the clock signal CK is the same as that of the first clock signal CK1. In this case, the timing of the inverted first clock signal ˆCK1 obtained by the third phase inverter module 6 is the same as that of the inverted clock signal ˆCK. Since the bidirectional scanning control signal CN is at a low level and the inverted bidirectional scanning control signal ˆCN is at a high level, the seventh transistor T7 and the eighth transistor T8 are turned on, that is to say, in this case, the first signal input terminal IN-UP receives the control signal (the STV signal for the gate drive unit in the last stage) output from the gate drive unit in its next stage; meanwhile, the fifth transistor T5 and the sixth transistor T6 are cut off, that is to say, the second signal input terminal IN-DOWN cannot receive the control signal (the STV signal for the gate drive unit in the first stage) output from the gate drive circuit in its previous stage.

In t2, at the falling edge of the clock signal CK, the control signal received by the first signal input terminal IN-UP and output from the gate drive circuit in the next stage of the current gate drive circuit, or the STV signal (Start Vertical signal) changes to a high level and remains at the high level for one clock period (t2+t3).

In t3, the clock signal CK changes to a high level and the inverted clock signal ˆCK which is obtained by inverting the clock signal CK by the first phase inverter module 1 changes to a low level. Specifically, since the clock signal CK is at a high level, in the first phase inverter module 1, the second transistor T2 is turned on and the first transistor T1 is cut off. Since the first electrode of the second transistor T2 is connected with a low-level signal input terminal VGL, the inverted clock signal ˆCK is at a low level. In this case, the ninth transistor T9 and the tenth transistor T10 in the intermediate signal generation module 4 are turned on. Meanwhile, since the bidirectional scanning control signal CN is at a low level and the inverted bidirectional scanning control signal ˆCN is at a high level, the seventh transistor T7 and the eighth transistor T8 are turned on. In this case, the control signal or the STV signal received by the first signal input terminal IN-UP is transferred to the logic inverter, which is constituted by the eleventh transistor T11 and the twelfth transistor T12, in the intermediate signal generation module 4 via the seventh transistor T7, the eighth transistor T8, the ninth transistor T9 and the tenth transistor T10, and then an intermediate signal MS is output. Since the control signal or the STV signal received by the first signal input terminal IN-UP is a high-level signal, the eleventh transistor T11 is cut off and the twelfth transistor T12 is turned on, so that the intermediate signal MS changes from a high-level signal to a low-level signal (and remains at the low level for one clock period (t3+t4)), which results in that the twenty-eighth transistor T28 is turned on and the thirtieth transistor T30 is cut off. Meanwhile, since the inverted first clock signal ˆCK1 is also at a low level, the twenty-seventh transistor T27 is turned on and the twenty-ninth transistor T29 is cut off. Thus, in t3, the output terminal GATE2 of the second driving module 8 outputs a high-level signal, so as to scan the gate line connected with the second driving module 8.

In t4, the clock signal CK changes from a high level to a low level and the inverted first clock signal ˆCK1 which is obtained by inverting the first clock signal CK1 by the third phase inverter module 6 changes to a high level, so that the twenty-seventh transistor T27 is cut off and the twenty-ninth transistor T29 is turned on. Specifically, the third phase inverter module 6 includes the twenty-first transistor T21 and the twenty-second transistor T22. When the first clock signal CK1 is at a low level, the twenty-first transistor T21 is turned on. Since the first electrode of the twenty-first transistor T21 is connected with a high-level signal input terminal VGH, the inverted first clock signal ˆCK1 also changes to a high level, so that the twenty-seventh transistor T27 is cut off and the twenty-ninth transistor T29 is turned on, and at this time, the output terminal GATE2 of the second gate driving module 8 outputs a low-level signal. Meanwhile, since both the intermediate signal MS and the first clock signal CK1 are at low levels, the twenty-third transistor T23 and the twenty-fourth transistor T24 are turned on and the twenty-fifth transistor T25 and the twenty-sixth transistor T26 are cut off. Therefore, the output terminal GATE1 of the first driving module 7 outputs a high-level signal, so as to scan the gate line connected with the first driving module 7. Meanwhile, in t4, since the inverted clock signal ˆCK is at a high level and the clock signal CK is at a low level, the transmission gate constituted by the thirteenth transistor T13 and the fourteenth transistor T14 is turned on. The intermediate signal MS passes through this transmission gate and then passes through the logic inverter constituted by the fifteenth transistor T15 and the sixteenth transistor T16. Since the intermediate signal MS is at a low level, both the control signal output to the gate drive unit in its previous stage by the first signal output terminal OUT-UP and the control signal output to the gate drive unit in its next stage by the second signal output terminal OUT-DOWN are at high levels.

In t5, the clock signal CK and the first clock signal CK1 change to high levels again, and the inverted clock signal ˆCK and the inverted first clock signal ˆCK1 change to low levels again. Meanwhile, since the control signal or the STV signal received by the first signal input-terminal IN-UP is at a low level, the intermediate signal MS changes to a high level. In this case, both the twenty-fourth transistor T24 and the twenty-eighth transistor T28 are cut off, and both the twenty-sixth transistor T26 and the thirtieth transistor T30 are turned on. Therefore, both the output terminal GATE1 of the first driving module 7 and the output terminal GATE2 of the second driving module 8 output low-level signals. Meanwhile, the transmission gate constituted by the thirteenth transistor T13 and the fourteenth transistor T14 is turned off, and thus, both the control signal output to the gate drive unit in its previous stage by the first signal output terminal OUT-UP and the control signal output to the gate drive unit in its next stage by the second signal output terminal OUT-DOWN remain at high levels.

In t6, when the clock signal CK changes to a low level again, the transmission gate constituted by the thirteenth transistor T13 and the fourteenth transistor T14 in the intermediate signal generation module 4 is turned on again. The intermediate signal MS passes through this transmission gate and then passes through the logic inverter constituted by the fifteenth transistor T15 and the sixteenth transistor T16. Since the intermediate signal MS is at a high level, both the control signal output to the gate drive unit in its previous stage by the first signal output terminal OUT-UP and the control signal output to the gate drive unit in its next stage by the second signal output terminal OUT-DOWN remain at low levels.

Each of the gate drive units in the gate drive circuit operates in the above described manner, so as to complete display of one frame.

Preferably, the first transistor T1, the second transistor T2, the third transistor T3, the fourth transistor T4, the fifth transistor T5, the sixth transistor T6, the seventh transistor T7, the eighth transistor T8, the ninth transistor T9, the tenth transistor T10, the eleventh transistor T11, the twelfth transistor T12, the thirteenth transistor T13, the fourteenth transistor T14, the fifteenth transistor T15, the sixteenth transistor T16, the seventeenth transistor T17, the eighteenth transistor T18, the nineteenth transistor T19, the twentieth transistor T20, the twenty-first transistor T21, the twenty-second transistor T22, the twenty-third transistor T23, the twenty-fourth transistor T24, the twenty-fifth transistor T25, the twenty-sixth transistor T26, the twenty-seventh transistor 27, the twenty-eighth transistor T28, the twenty-ninth transistor T29 and the thirtieth transistor 130 are low temperature poly-silicon thin film transistors. Since the N-type and P-type low temperature poly-silicon thin film transistors can be manufactured at the same time, they can be manufactured more easily.

Embodiment 2

The present embodiment provides an array substrate, which includes the gate drive circuit described in Embodiment 1. Compared to the prior art, the effective display area of the array substrate in the present embodiment is relatively large. The array substrate further includes a plurality of gate lines, which are connected with the gate drive circuit. Of course, the array substrate also includes known elements such as data lines, thin film transistors, and the like.

Embodiment 3

The present embodiment provides a display device, which includes the array substrate of Embodiment 2 and a clock signal generation module which is used for providing a clock signal for the gate drive circuit on the array substrate. The display device may further include a bidirectional scanning control signal generation unit which is used for providing a bidirectional scanning control signal for the gate drive circuit on the array substrate. The display device may be any product or component with a display function, such as a liquid crystal display panel, an electronic paper, a mobile phone, a tablet computer, a television, a monitor. a laptop computer, a digital frame or a navigator.

It should be understood that the forgoing embodiments are merely exemplary embodiments used for illustrating the principle of the present invention, but the present invention is not limited thereto. For a person skilled in the art, various modifications and improvements can be made without departing from the spirit and essence of the present invention. These modifications and improvements are also deemed to be the protection scope of the present invention.

What is claimed is:

1. A gate drive circuit, including: a plurality of cascaded gate drive units, wherein each of the gate drive units is used for driving two adjacent gate lines and includes: a clock signal input terminal, a first signal input terminal, a first signal output terminal, a second signal input terminal, a second terminal output terminal, a first phase inverter module, an intermediate signal generation module, a first driving module and a second driving module, wherein for each of the gate drive units, the first signal input terminal is used for receiving a control signal output from the gate drive unit in its next stage and the second signal input terminal is used for receiving a control signal output from the gate drive unit in its previous stage;

for each of the gate drive units, the first signal output terminal is used for outputting a control signal to the gate drive unit in its previous stage and the second signal output terminal is used for outputting a control signal to the gate drive unit in its next stage;

the first phase inverter module is connected with the first driving module, the second driving module and the intermediate signal generation module, and is used for inverting a clock signal received by the clock signal input terminal, and the first driving module, the second driving module and the intermediate signal generation module are controlled by the inverted clock signal;

the intermediate signal generation module is connected with the first signal input terminal, the second signal input terminal, the clock signal input terminal, the first signal output terminal, the second signal output terminal and an output terminal of the first phase inverter module, and generates an intermediate signal under the control of the control signals input from the first signal input terminal and the second signal input terminal, the clock signal and the inverted clock signal, and outputs a control signal to the gate drive unit in its previous stage through the first signal output terminal and outputs a control signal to the gate drive unit in its next stage through the second signal output terminal; and the first driving module and the second driving module output corresponding scanning signals under the control of the inverted clock signal and the intermediate signal, so as to scan the respective gate lines connected thereto.

2. The gate drive circuit according to claim 1, each of the gate drive units further includes a bidirectional scanning control signal input terminal, a second phase inverter module, a third phase inverter module, a scanning direction control module and a clock selection module, wherein the bidirectional scanning control signal input terminal is used for receiving a bidirectional scanning control signal;

the second phase inverter module is connected with the scanning direction control module, and is used for inverting the bidirectional scanning control signal, and gating of the scanning direction control module is controlled by the inverted bidirectional scanning control signal;

the scanning direction control module is connected with the first signal input terminal, the second signal input terminal and the intermediate signal generation module, and transfers the control signals received by the first signal input terminal and the second signal input terminal to the intermediate signal generation module under the control of the inverted bidirectional scanning control signal, so as to generate an intermediate signal;

the clock selection module is connected with the first phase inverter module, the clock signal input terminal, the first driving module and the bidirectional scanning control signal input terminal, and is used for generating a first clock signal under the control of the clock signal, the inverted clock signal and the bidirectional scanning control signal;

the third phase inverter module is connected with the clock selection module and the second driving module, and is used for inverting the first clock signal;

the first driving module outputs a scanning signal to a gate line connected thereto under the control of the first clock signal and the intermediate signal; and the second driving module outputs a scanning signal to a gate line connected thereto under the control of the inverted first clock signal and the intermediate signal.

3. The gate drive circuit according to claim 2, wherein the first phase inverter module includes a first transistor and a second transistor, wherein the first transistor is a P-type transistor and the second transistor is a N-type transistor;

a first electrode of the first transistor is connected with a high-level signal input terminal, a second electrode thereof is connected with a second electrode of the second transistor, and a control electrode thereof is connected with a control electrode of the second transistor and the clock signal input terminal; and a first electrode of the second transistor is connected with a low-level signal input terminal.

4. The gate drive circuit according to claim 3, wherein the second phase inverter module includes a third transistor and a fourth transistor, wherein the third transistor is a P-type transistor and the fourth transistor is a N-type transistor;

a first electrode of the third transistor is connected with a high-level signal input terminal, a second electrode thereof is connected with a second electrode of the fourth transistor, and a control electrode thereof is connected with the bidirectional scanning control signal input terminal; and a first electrode of the fourth transistor is connected with a low-level signal input terminal.

5. The gate drive unit according to claim 4, wherein the scanning direction control module includes a fifth transistor, a sixth transistor, a seventh transistor and an eighth transistor, wherein the fifth transistor and the seventh transistor are P-type transistors and the sixth transistor and the eighth transistor are N-type transistors;

a first electrode of the fifth transistor is connected with a first electrode of the sixth transistor and the second signal input terminal, a second electrode thereof is connected with a second electrode of the sixth transistor, a second electrode of the seventh transistor and a second electrode of the eighth transistor, and a control electrode thereof is connected with the second electrode of the third transistor and a control electrode of the eighth transistor;

a control electrode of the sixth transistor is connected with a control electrode of the seventh transistor and the bidirectional scanning control signal input terminal; and a first electrode of the seventh transistor is connected with a first electrode of the eighth transistor and the first signal input terminal.

6. The gate drive circuit according to claim 5, wherein the intermediate signal generation module includes a ninth transistor, a tenth transistor, an eleventh transistor, a twelfth transistor, a thirteenth transistor, a fourteenth transistor, a fifteenth transistor, a sixteenth transistor and an intermediate signal output terminal, wherein the ninth transistor, the eleventh transistor, the fourteenth transistor and the fifteenth transistor are P-type transistors, and the tenth transistor, the twelfth transistor, the thirteenth transistor and the sixteenth transistor are N-type transistors, and the intermediate signal generation module outputs a generated intermediate signal through the intermediate signal output terminal;

a first electrode of the ninth transistor is connected with a first electrode of the tenth transistor and the second electrode of the fifth transistor, a second electrode thereof is connected with a second electrode of the tenth transistor and a control electrode of the eleventh transistor and a control electrode of the twelfth transistor, and a control electrode thereof is connected with the second electrode of the first transistor;

a control electrode of the tenth transistor is connected with the clock signal input terminal;

a first electrode of the eleventh transistor is connected with a high-level signal input terminal, a second electrode thereof is connected with a second electrode of the twelfth transistor, a first electrode of the thirteenth transistor, a first electrode of the fourteenth transistor and the intermediate signal output terminal;

a first electrode of the twelfth transistor is connected with a low-level signal input terminal;

a second electrode of the thirteenth transistor is connected with a second electrode of the fourteenth transistor, a control electrode of the fifteenth transistor and a control electrode of the sixteenth transistor, and a control electrode thereof is connected with the control electrode of the ninth transistor;

a control electrode of the fourteenth transistor is connected with the clock signal input terminal;

a first electrode of the fifteenth transistor is connected with a high-level signal input terminal, a second electrode thereof is connected with a second electrode of the sixteenth transistor, the first signal output terminal and the second signal output terminal; and a first electrode of the sixteenth transistor is connected with a low-level signal input terminal.

7. The gate drive unit according to claim 6, wherein the clock selection module includes a seventeenth transistor, an eighteenth transistor, a nineteenth transistor and a twentieth transistor, wherein the seventeenth transistor and the nineteenth transistor are P-type transistors and the eighteenth transistor and the twentieth transistor are N-type transistors;

a first electrode of the seventeenth transistor is connected with the second electrode of the first transistor and a first electrode of the eighteenth transistor, a second electrode thereof is connected with a second electrode of the eighteenth transistor, a second electrode of the nineteenth transistor and a second electrode of the twentieth transistor, and a control electrode thereof is connected with the control electrode of the fifth transistor and a control electrode of the twentieth transistor;

a control electrode of the eighteenth transistor is connected with a control electrode of the nineteenth transistor and the bidirectional scanning control signal input terminal; and a first electrode of the nineteenth transistor is connected with a first electrode of the twentieth transistor and the clock signal input terminal.

8. The gate drive circuit according to claim 7, wherein the third phase inverter module includes a twenty-first transistor and a twenty-second transistor, wherein the twenty-first transistor is a P-type transistor and the twenty-second transistor is a N-type transistor;

a first electrode of the twenty-first transistor is connected with a high-level signal input terminal, a second electrode thereof is connected with a second electrode of the twenty-second transistor, and a control electrode thereof is connected with a control electrode of the twenty-second transistor and the second electrode of the seventeenth transistor; and a first electrode of the twenty-second transistor is connected with a low-level signal input terminal.

9. The gate drive circuit according to claim 8, wherein the first driving module includes a twenty-third transistor, a twenty-fourth transistor, a twenty-fifth transistor and a twenty-sixth transistor, wherein the twenty-third transistor and the twenty-fourth transistor are P-type transistors and the twenty-fifth transistor and the twenty-sixth transistor are N-type transistors;

a first electrode of the twenty-third transistor is connected with a high-level signal input terminal, a second electrode thereof is connected with a first electrode of the twenty-fourth transistor, and a control electrode thereof is connected with a control electrode of the twenty-fifth transistor and the second electrode of the seventeenth transistor;

a second electrode of the twenty-fourth transistor is connected with a second electrode of the twenty-fifth transistor, a second electrode of the twenty-sixth transistor and an output terminal of the first driving module, and a control electrode thereof is connected with a control electrode of the twenty-sixth transistor and the intermediate signal output terminal, wherein the output terminal of the first driving module is connected with a gate line; and a first electrode of the twenty-fifth transistor is connected with a first electrode of the twenty-sixth transistor and a low-level signal input terminal.

10. The gate drive circuit according to claim 9, wherein the second driving module includes a twenty-seventh transistor, a twenty-eighth transistor, a twenty-ninth transistor and a thirtieth transistor, wherein the twenty-seventh transistor and the twenty-eighth transistor are P-type transistors and the twenty-ninth transistor and the thirtieth transistor are N-type transistors;

a first electrode of the twenty-seventh transistor is connected with a high-level signal input terminal, a second electrode thereof is connected with a first electrode of the twenty-eighth transistor, and a control electrode thereof is connected with the second electrode of the twenty-first transistor and a control electrode of the twenty-ninth transistor;

a second electrode of the twenty-eighth transistor is connected with a second electrode of the twenty-ninth transistor, a second electrode of the thirtieth transistor and an output terminal of the second driving module, and a control electrode thereof is connected with a control electrode of the thirtieth transistor and the intermediate signal output terminal, wherein the output terminal of the second driving module is connected with another gate line; and a first electrode of the twenty-ninth transistor is connected with a first electrode of the thirtieth transistor and a low-level signal input terminal.

11. The gate drive circuit according to claim 10, wherein the first transistor, the second transistor, the third transistor, the fourth transistor, the fifth transistor, the sixth transistor, the seventh transistor, the eighth transistor, the ninth transistor, the tenth transistor, the eleventh transistor, the twelfth transistor, the thirteenth transistor, the fourteenth transistor, the fifteenth transistor, the sixteenth transistor, the seventeenth transistor, the eighteenth transistor, the nineteenth transistor, the twentieth transistor, the twenty-first transistor, the twenty-second transistor, the twenty-third transistor, the twenty-fourth transistor, the twenty-fifth transistor, the twenty-sixth transistor, the twenty-seventh transistor, the twenty-eighth transistor, the twenty-ninth transistor and the thirtieth transistor are low temperature poly-silicon thin film transistors.

12. An array substrate, including the gate drive circuit according to claim 1 and a plurality of gate lines connected with the gate drive circuit.

13. The array substrate according to claim 12, wherein each of the gate drive units in the gate drive circuit further includes a bidirectional scanning control signal input terminal, a second phase inverter module, a third phase inverter module, a scanning direction control module and a clock selection module, wherein the bidirectional scanning control signal input terminal is used for receiving a bidirectional scanning control signal;

the second phase inverter module is connected with the scanning direction control module, and is used for inverting the bidirectional scanning control signal, and gating of the scanning direction control module is controlled by the inverted bidirectional scanning control signal;

the scanning direction control module is connected with the first signal input terminal, the second signal input terminal and the intermediate signal generation module, and transfers the control signals received by the first signal input terminal and the second signal input terminal to the intermediate signal generation module under the control of the inverted bidirectional scanning control signal, so as to generate an intermediate signal;

the clock selection module is connected with the first phase inverter module, the clock signal input terminal, the first driving module and the bidirectional scanning control signal input terminal, and is used for generating a first clock signal under the control of the clock signal, the inverted clock signal and the bidirectional scanning control signal;

the third phase inverter module is connected with the clock selection module and the second driving module, and is used for inverting the first clock signal;

the first driving module outputs a scanning signal to a gate line connected thereto under the control of the first clock signal and the intermediate signal; and the second driving module outputs a scanning signal to a gate line connected thereto under the control of the inverted first clock signal and the intermediate signal.

14. A display device, including the array substrate according to claim 12 and a clock signal generation unit which provides a clock signal for the gate drive circuit on the array substrate.

15. The display device according to claim 14, wherein each of the gate drive units in the gate drive circuit on the array substrate further includes a bidirectional scanning control signal input terminal, a second phase inverter module, a third phase inverter module, a scanning direction control module and a clock selection module, wherein the bidirectional scanning control signal input terminal is used for receiving a bidirectional scanning control signal;

the second phase inverter module is connected with the scanning direction control module, and is used for inverting the bidirectional scanning control signal, and gating of the scanning direction control module is controlled by the inverted bidirectional scanning control signal;

the scanning direction control module is connected with the first signal input terminal, the second signal input terminal and the intermediate signal generation module, and transfers the control signals received by the first signal input terminal and the second signal input terminal to the intermediate signal generation module under the control of the inverted bidirectional scanning control signal, so as to generate an intermediate signal;

the clock selection module is connected with the first phase inverter module, the clock signal input terminal, the first driving module and the bidirectional scanning control signal input terminal, and is used for generating a first clock signal under the control of the clock signal, the inverted clock signal and the bidirectional scanning control signal;

the third phase inverter module is connected with the clock selection module and the second driving module, and is used for inverting the first clock signal;

the first driving module outputs a scanning signal to a gate line connected thereto under the control of the first clock signal and the intermediate signal; and the second driving module outputs a scanning signal to a gate line connected thereto under the control of the inverted first clock signal and the intermediate signal.

16. The display device according to claim 14, further including a bidirectional scanning control signal generation unit, which provides a bidirectional scanning control signal for the gate drive circuit on the array substrate.

17. The display device according to claim 15, further including a bidirectional scanning control signal generation unit, which provides a bidirectional scanning control signal for the gate drive circuit on the array substrate.

* * * * *